US012642360B2

(12) United States Patent
Melecki

(10) Patent No.: US 12,642,360 B2
(45) Date of Patent: Jun. 2, 2026

(54) PURIFIER, FAN, AND/OR AIR CIRCULATOR FOR USE NEAR SLEEPING AREA, AND METHOD OF MAKING AND USING SAME

(71) Applicant: Sereniby Inc., Philadelphia, PA (US)

(72) Inventor: Alexander M. Melecki, Philadelphia, PA (US)

(73) Assignee: Sereniby Inc., Philadelphia, PA (US)

( * ) Notice: Subject to any disclaimer, the term of this patent is extended or adjusted under 35 U.S.C. 154(b) by 42 days.

(21) Appl. No.: 18/756,887

(22) Filed: Jun. 27, 2024

(65) Prior Publication Data

US 2025/0017389 A1 Jan. 16, 2025

Related U.S. Application Data

(60) Provisional application No. 63/525,952, filed on Jul. 10, 2023.

(51) Int. Cl.
*A47C 21/04* (2006.01)
*A47C 21/00* (2006.01)
(Continued)

(52) U.S. Cl.
CPC ..... *A47C 21/044* (2013.01); *A47C 21/003* (2013.01); *A47D 9/00* (2013.01);
(Continued)

(58) Field of Classification Search
CPC ..... F24F 2221/10; A47D 15/00; A47D 9/00
See application file for complete search history.

(56) References Cited

U.S. PATENT DOCUMENTS 5,592,704 A * 1/1997 Breese ..... A47C 21/044 5/93.1
5,730,120 A * 3/1998 Yonkers, Jr. ..... A47C 21/044 128/202.13
(Continued)

FOREIGN PATENT DOCUMENTS

CN 204447560 U * 7/2015
CN 105683667 A * 6/2016 ..... F24F 8/108
(Continued)

OTHER PUBLICATIONS

Translation CN-105683667-A (Year: 2025).*
(Continued)

*Primary Examiner* — J. T. Newton
(74) *Attorney, Agent, or Firm* — Mark T. Vogelbacker; Eckert Seamans Cherin & Mellott, LLC

(57) ABSTRACT

A combination including a crib or bed having a support surface located a predetermined distance about a ground surface and an air circulator. The support surface extends parallel to the ground surface. The support surface can be configured to support a human or baby in a sleeping state. The air circulator can have a housing, a base, and a support structure therebetween. The base can be placed on the ground surface proximate the crib. The support surface can be adjustable to adjust a height of the housing above the base. A vertical midportion of the housing can be located above the support surface of the crib or bed. The housing can be directed toward the support surface of the crib or bed to circulate air at the support surface.

17 Claims, 8 Drawing Sheets

(51) Int. Cl.
*A47D 9/00* (2006.01)
*A47D 15/00* (2006.01)
*F24F 8/80* (2021.01)

(52) U.S. Cl.
CPC ..... *A47D 15/00* (2013.01); *F24F 8/80* (2021.01); *F24F 2221/10* (2013.01)

(56) References Cited

U.S. PATENT DOCUMENTS

| | | | | |
|---|---|---|---|---|
| 2003/0140418 | A1* | 7/2003 | Klamm | A47C 21/048 5/423 |
| 2012/0052786 | A1* | 3/2012 | Clawsey | F24F 11/52 454/229 |
| 2015/0173522 | A1* | 6/2015 | Manouchehri | A47C 21/044 5/423 |
| 2019/0085852 | A1* | 3/2019 | Brown | A61L 9/122 |

FOREIGN PATENT DOCUMENTS

| | | | |
|---|---|---|---|
| CN | 221533328 | U * | 8/2024 |
| JP | 5997857 | B1 * | 9/2016 |

OTHER PUBLICATIONS

Translation CN-204447560-U (Year: 2025).*
Translation CN-221533328-U (Year: 2025).*
Translation JP-5997857-B1 (Year: 2025).*

* cited by examiner

PURIFIER, FAN, AND/OR AIR CIRCULATOR FOR USE NEAR SLEEPING AREA, AND METHOD OF MAKING AND USING SAME

CROSS REFERENCE TO RELATED APPLICATION

The present application claims priority to U.S. Provisional Application No. 63/525,952, filed Jul. 10, 2023, the entire disclosure of which is hereby incorporated by reference.

BACKGROUND

In modern environments, humans can be exposed to harmful airborne pollutants that negatively impact their health and development. While this can be problematic for any age group, infants are particularly vulnerable. For example, improper or insufficient air circulation in an infant's sleeping environment is often cited as a key contributor to Sudden Infant Death Syndrome (SIDS). Currently available devices, including air purifiers and traditional fans, have limitations and do not cater to the specific needs of babies.

SUMMARY

The presently disclosed technology addresses the above and other needs found in the prior art.

One embodiment of the presently disclosed technology addresses indoor environmental problems that can pose a risk to infant health and development—air quality and air circulation. It has been found that the presence of fine particulate matter that are less than 2.5 micrometers in diameter (i.e., PM2.5 particles) can pose the greatest risk to health. PM2.5 levels are increasing overall, and the air quality in homes or other indoor environments can often be materially worse than outside. Separately, lack of air circulation has been found to cause negative effects in humans, and is often cited as a key risk factor for SIDS. Experts theorize that the lack of air circulation leads to humans rebreathing exhaled $CO_2$. Babies are particularly vulnerable to the above, because due to their rapid growth and development. Babies breath more quickly than do adults, which amplifies the impact and/or rick of poor air quality.

In one optional embodiment, the presently disclosed technology is designed for the safe and healthy development of infants.

In one embodiment, the presently disclosed technology is a smart air purifier and/or air circulator for use near a sleeping area and a method of making and using same. The device and/or system is an integrated smart air purifier, circulating nursery fan, and/or sleep-training device, designed to purify and circulate air in a baby's nursery or near a baby's crib, which can mitigate the harmful effects of airborne pollutants and dangerous carbon dioxide (CO2) build-up.

In one embodiment, the device integrates sleep and wake lighting, which is controllable via an associated smartphone application, provides convenient and effective support for parents teaching healthy sleep habits to their children.

In one embodiment, the presently disclosed technology is directed to a combination that can include a crib or bed having a support surface located a predetermined distance about a ground surface. The support surface can extend parallel to the ground surface. The support surface can be configured to support a human or baby in a sleeping state. The combination can also include an air circulator having a housing, a base, and a support structure therebetween. The base can be placed on the ground surface proximate the crib. The support surface can be adjustable to adjust a height of the housing above the base. A vertical midportion of the housing can be located above the support surface of the crib or bed. The housing can be directed toward the support surface of the crib or bed to circulate air at the support surface.

BRIEF DESCRIPTION OF THE DRAWINGS

The following detailed description of the presently disclosed technology will be better understood when read in conjunction with the appended drawings, wherein like numerals designate like elements throughout. For the purpose of illustrating the presently disclosed technology, there are shown in the drawing's various illustrative embodiments. It should be understood, however, that the presently disclosed technology is not limited to the precise arrangements and instrumentalities shown. In the drawings.

DETAILED DESCRIPTION

Figure 1:
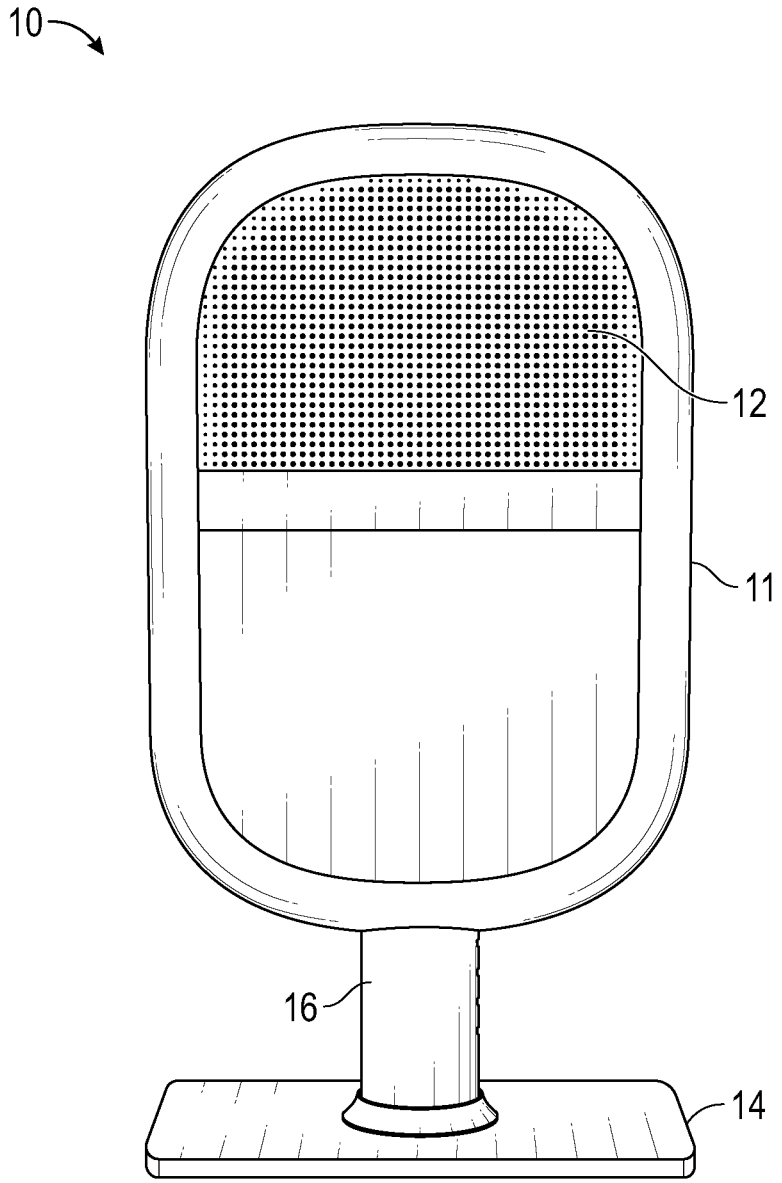
FIG. 1 is a front elevation view of a device according to an embodiment of the presently disclosed technology.

While systems, devices, and methods are described herein by way of examples and embodiments, those skilled in the art recognize that the presently disclosed technology is not limited to the embodiments or drawings described. Rather, the presently disclosed technology covers all modifications, equivalents and alternatives falling within the spirit and scope of the appended claims. Features of any one embodiment disclosed herein can be omitted or incorporated into another embodiment.

Any headings used herein are for organizational purposes only and are not meant to limit the scope of the description or the claims. As used herein, the word "may" is used in a permissive sense (i.e., meaning, having the potential to) rather than the mandatory sense (i.e., meaning, must). Unless specifically set forth herein, the terms "a," "an" and "the" are not limited to one element but instead should be read as meaning "at least one." The terminology includes the words noted above, derivatives thereof and words of similar import.

As used herein, "and/or" means that either or both of the items separated by such terminology are involved. For example, the phrase "A and/or B" should be read to mean A alone, B alone, or both A and B.

As used herein, "generally" means "in a general manner" relevant to the term being modified as would be understood by one of ordinary skill in the art.

Directional phrases used herein, for example and without limitation, top, bottom, left, right, upper, lower, front, back, and derivatives thereof, relate to the orientation of the elements shown in the drawings and are not limiting upon the claims unless expressly recited therein.

Referring to the drawings in detail, wherein like numerals designated like elements throughout, FIGS. 1-8 show a device, generally designated 10, of one optional embodiment of the present disclosure that is configured to cool and/or purify air near or at a sleeping area of an individual, such as a baby. FIG. 1 shows the device 10 from a front view that includes a housing 11 having a finger-safe vent or surface 12 through which clean air is expelled, allowing for placement directly adjacent to an infant's or user's sleeping area. A plurality of spaced-apart opening of the finger-safe vent or surface 12 are sufficiently sized and/or shaped to prevent a finger from contacting an air circulator (e.g., the blade 13 of a fan or air circulator) within the device 10, while allowing sufficient flow of air therethrough. This placement of the finger-safe vent or surface 12 ensures consistent/even disbursement of any carbon dioxide ($CO_2$) build-up in the sleeping area, which is typically generated by an infant's exhalation and has been linked to SIDS.

Figure 2:
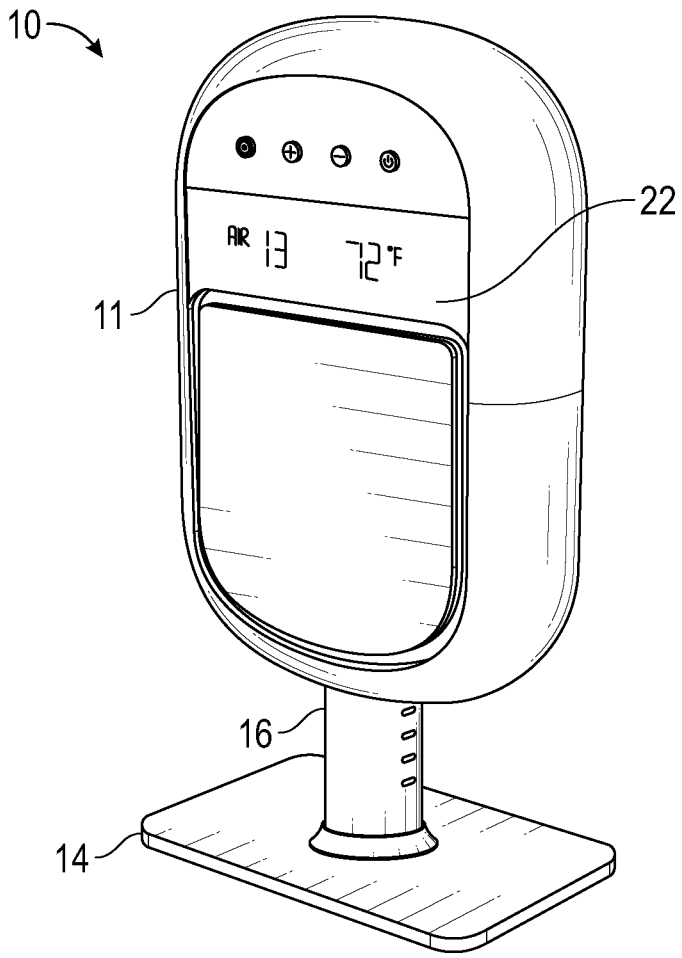
FIG. 2 is a perspective view of the device of FIG. 1.

FIG. 2 shows the device 10 from a rear or side having a baby-safe, anti-tip base 14 and a stand 16 with adjustable height, which ensures the air-circulation mechanism within the housing 11 can be placed at the optimal height for $CO_2$ disbursement in a variety of contexts and can be adjusted up or down over time (i.e., when the mattress 38 in a baby's crib 20 is lowered as the baby grows/ages).

Figure 3:
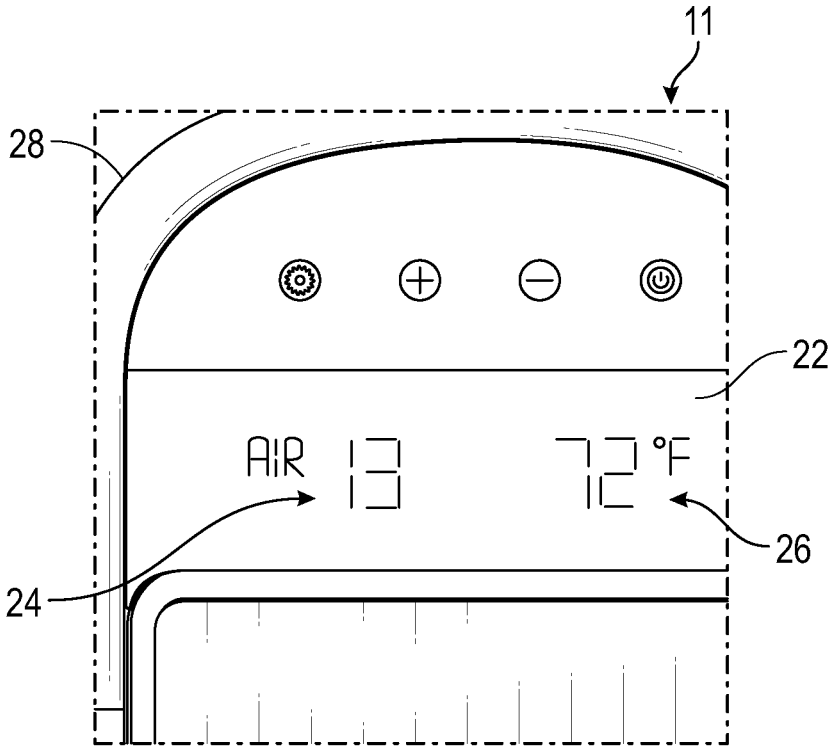
FIG. 3 is a magnified view of a portion of the device of FIG. 1.

FIG. 3 shows a magnified view of a portion of the housing 11 of the device 10 with a low-light, sleep-friendly display 22 showing sensor read-outs, including indoor Air Quality Index (AQI) 24 and temperature 26. In one embodiment, one of the sensors is reading PM2.5 concentration (i.e., micrograms of PM2.5 particles per cubic meter of air). The display 22 can be located on an opposite side of the housing 11 from the finger-safe vent or surface 12, which prevents or reduces the likelihood of disturbing or distracting the baby and allows the parent or user to visually monitor the environment from afar. The display 22 can include one or more push buttons that allow a user to control operation of the device 10, such as an on/off button, an increase fan speed button, a decrease fan speed button, and/or an on/off button for the light.

Figure 4:
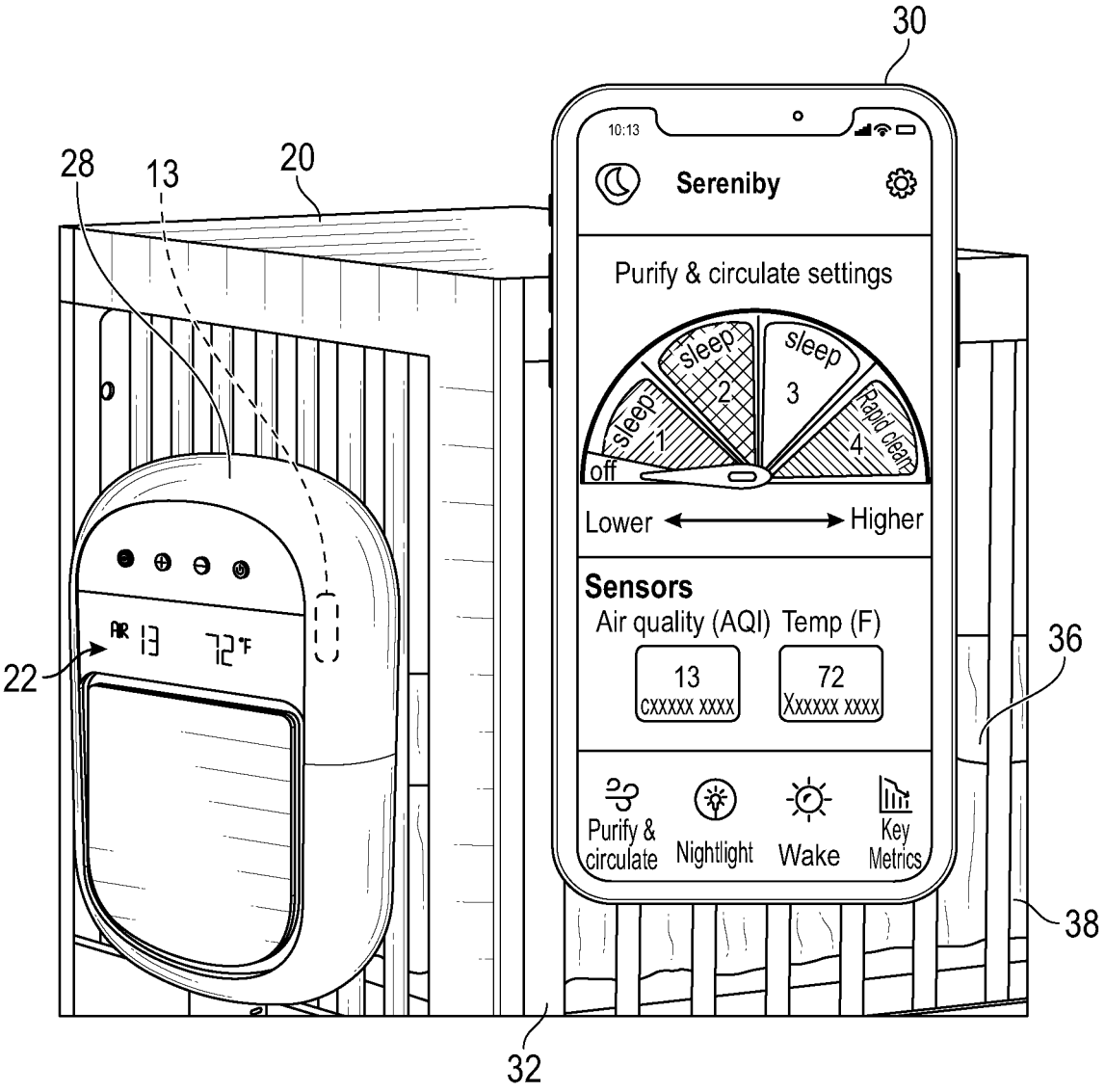
FIG. 4 is a perspective view of the device of FIG. 1 shown near a baby's crib and a computing device according to one embodiment of the presently disclosed technology.

FIG. 4 shows potential placement of the device 10 near an infant's crib 20, allowed for by integrated safety features (e.g., anti-strangulation, hidden, and/or retractable power cord, finger-safe air circulation vent 12, and/or anti-tip mechanism(s), as described below). The placement of one or more of the above-described features ensures optimal effective $CO_2$ disbursement, which research suggests can provide anti-SIDS benefits, while also creating a device that is safe for a baby's room. FIG. 4 also shows an illustration of a smart, Wi-Fi-enabled controls, which can be used to manipulate, control, and/or monitor the device 10.

Figure 5:
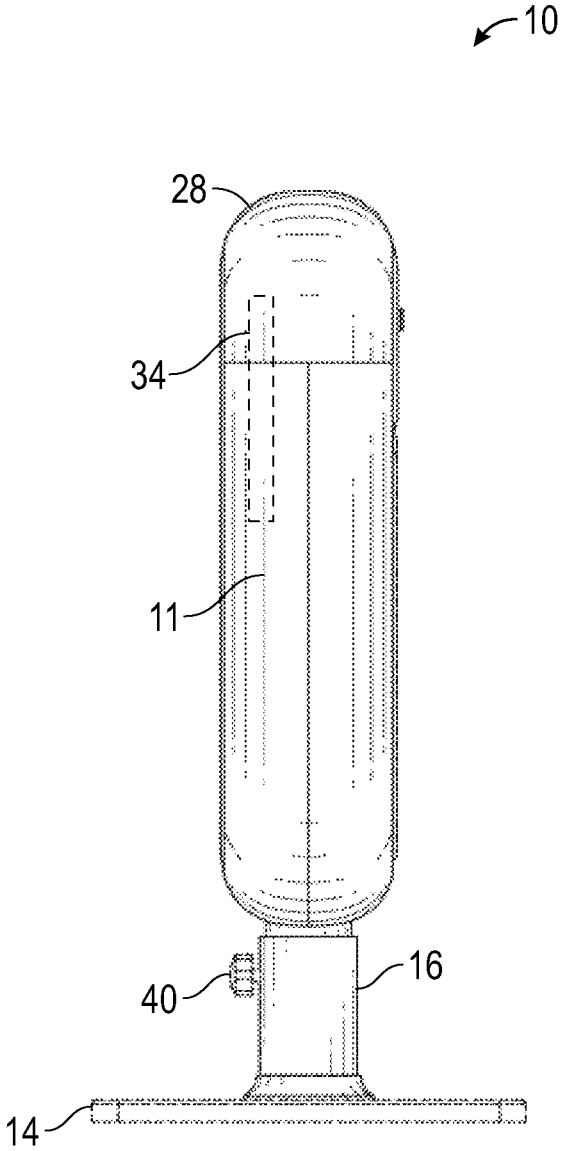
FIG. 5 is a side elevation view of the device of FIG. 1.
Figure 6:
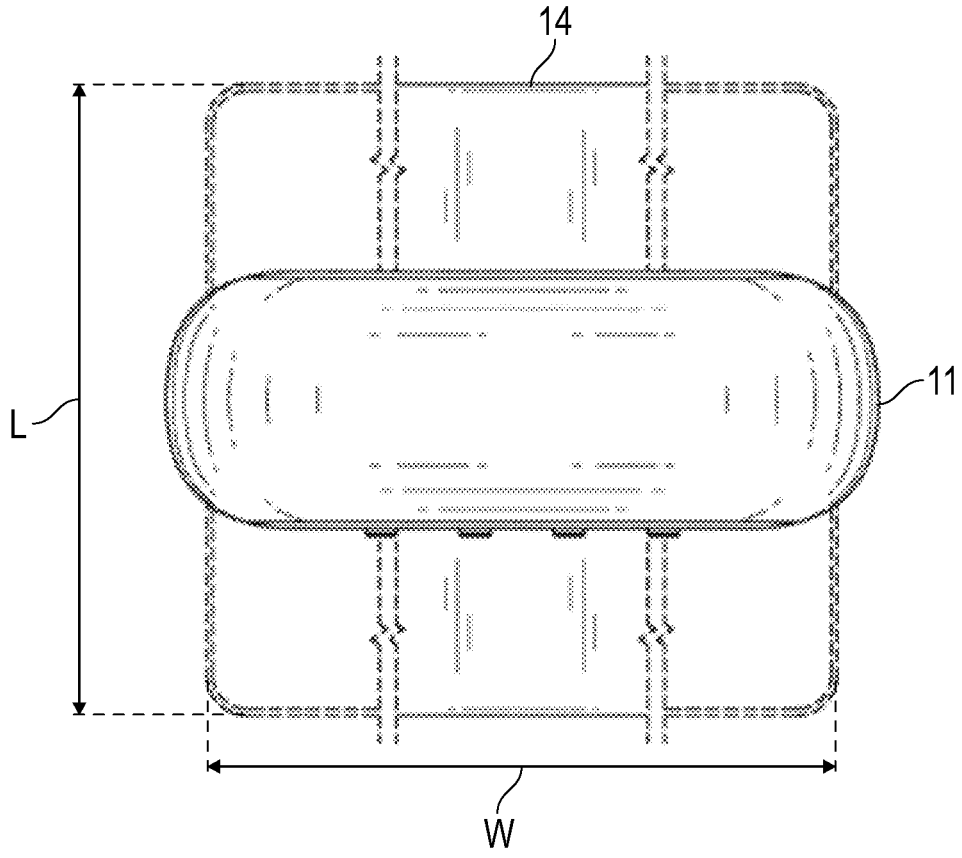
FIG. 6 is a top plan view of the device of FIG. 1.
Figure 7:
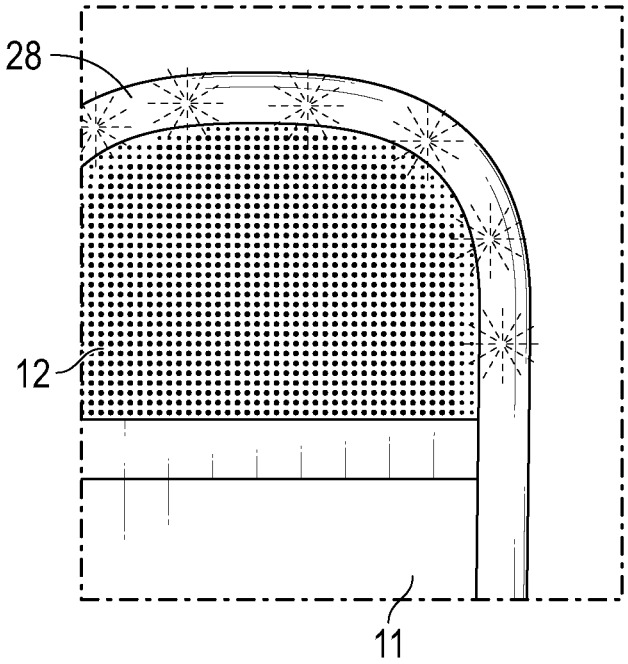
FIG. 7 is a magnified view of a portion of a device of one embodiment of the presently disclosed technology.

FIG. 5 shows an embodiment of one or more integrated sleep- and/or wake-lighting features 28, including pure-red LED to support natural nighttime melatonin production and toddler-friendly wake-lighting, which can be set and controlled via an associated smart/Wi-Fi-enabled app from a computing device 30, such as a mobile phone, to support development of healthy sleep and wake habits. The lighting feature(s) 28 can be located at and/or incorporated into a top of the housing 11 of the device 11, such that the lighting feature(s) 28 extend in an arch and are not distinguishable from the housing 11 when the lighting feature(s) 28 are in the "OFF" position or configuration.

The device 10 can include several safety features, including hidden (i.e., not visible and/or easily accessible) fan blades 13 to prevent accidental contact by infants. Additionally, the device 10 can optionally utilize a tubular, plastic coverage mechanism to encase the necessary electrical cord. This encasement mechanism makes the cord stiff/rigid, preventing it from wrapping around a baby's body. In another embodiment, the electric cord is designed to be inserted into the bottom of the base 14 and/or the housing 11 at a point where it would not be reachable from inside of a baby's crib.

Figure 8:
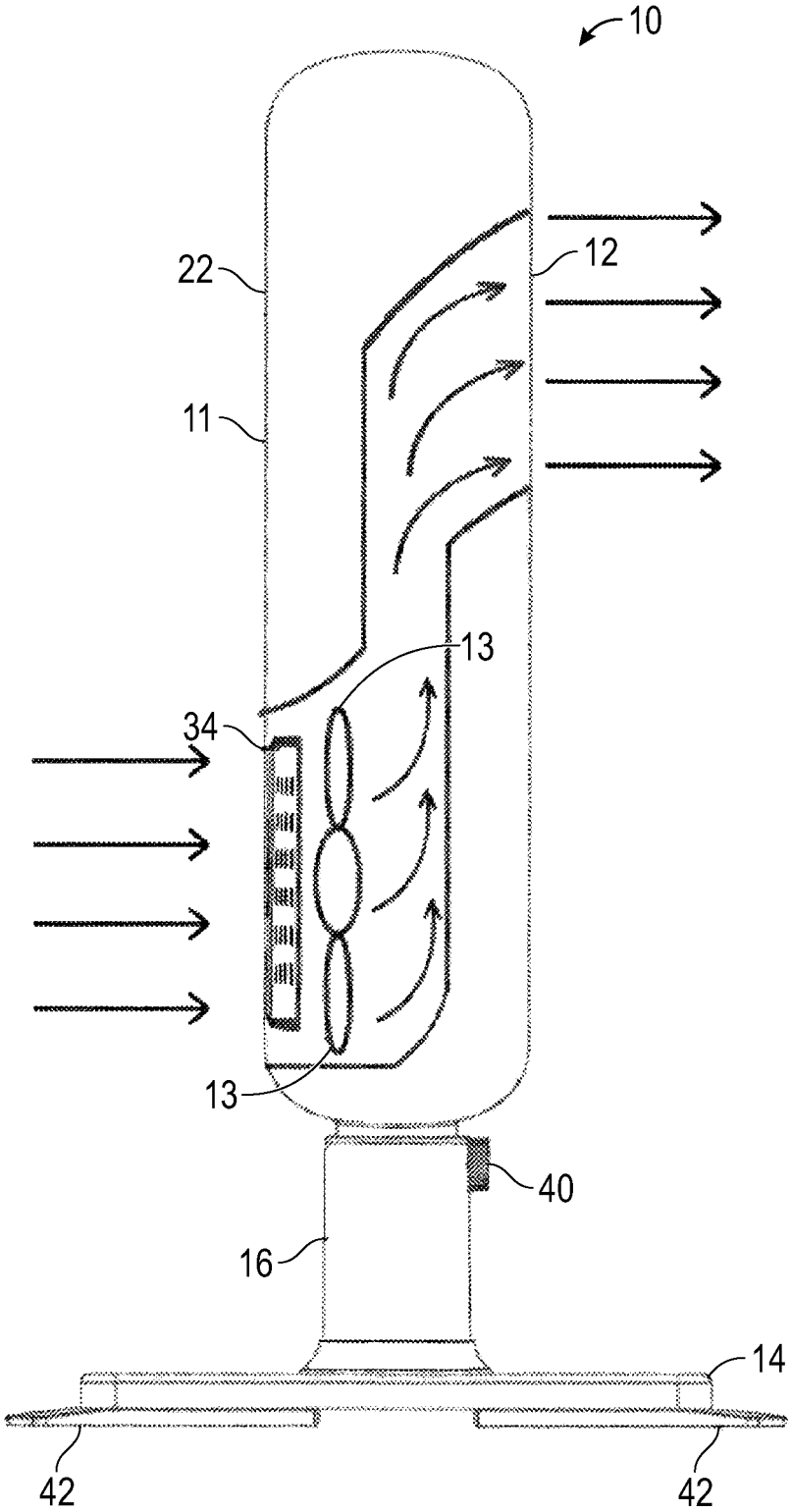
FIG. 8 is a schematic cross-sectional side elevation view of the device of FIG. 1.

In one optional embodiment, the base 14 of the device 10 is proportionally dimensioned and weighted based on the overall size and/or shape of the device, providing anti-tip protection. As shown in FIGS. 1, 2, 5, and 6, the base 14 can be rectangular or square in shape when viewed from above or below, and flat or planar when viewed from a side elevation perspective. When viewed from above (e.g., see FIG. 6), a width W of the base 14 can be the same as or slightly less than that of the housing 11 of the device 10. However, when viewed from above, a length L of the base 14 can be significantly greater than (e.g., two times or more) that of the housing 11 of the device 10. Such a configured prevents or reduces inadvertent tipping of the device 10. In addition or alternatively, as shown in FIG. 8, the base 14 can include one or more (e.g., four) legs 42 that extend laterally or radially outwardly from a remainder of the base 14, optionally in an "X" pattern when viewed from above.

In one optional embodiment, the device 10 can include an associated anchoring kit, which can include one or more hook-and-loop type straps that can be fastened around the legs 32 of a baby's crib 20 for yet another layer of anti-tip protection. In a case where the device 10 were to be pushed or pulled with sufficient force to overcome the inherent stability provided by the base 14, the straps included within the anti-tip kit would provide sufficient tension to prevent device 10 from falling over. When combined, the above-described safety features enable device 10 to be placed in close proximity to an infant's sleeping area, providing the most effective possible circulation of air and $CO_2$ disbursement.

The device 10 can utilize one or more filters 34, such as those incorporating advanced medical-grade HEPA technology (H13+), to clean air in the baby's nursery, reducing air pollutants such as viruses, pollution particles, wildfire smoke, and other impurities. The filter(s) 34 used by the device 10 can be removeable and replaceable, ensuring the device 10 can consistently deliver a high standard of air filtration within a baby's environment. Optionally, one or more of the filters 34 can be replaced by opening a hidden latch or door on the side, for example, of the device 10 that is meant to be positioned facing away from the baby's sleeping area, providing an extra layer of child-proofing. When the filter(s) 34 are placed within the housing 11, the filter(s) 34 is/are surrounded by the housing 11 and optionally not visible from exterior to the housing 11. Beyond the air filtration mechanism, the integrated circulating fan system 13 circulates air and/or disperses $CO_2$ build-up.

In one embodiment, the device 10 can be reconfigured between or among varying heights by way of shifting the housing 11 of the device 10 up or down via the stand 16, which can be in the form of a central, cylindrical leg that connects the housing 11 to the base 14. Optionally, the leg can be fashioned with or include one or a series of latching mechanisms separated by a predetermined amount, such as a maximum of 4 inches each. Optionally, the leg can include two telescoping tubes, one of which can include a spring-loaded peg or tab, or a peg or tab without a spring, that is biased to fit within one of a series of slots the other telescoping tube. Optionally, the leg can include a rotatable or axially-movable knob 40 (see FIG. 5) that allows a user to selectively raise or lower the housing 11 with respect to the base 14, and then temporarily lock the housing 11 into a desired height. The latching mechanism(s) can ensure that the device 10 can be appropriately and/or selectively positioned to ventilate infant sleeping areas having different heights. By enabling the height of the device 10 to closely align with that of an infant's sleeping or support surface 36 (see FIG. 4), the device 10 is able to provide maximal air circulation benefits (i.e., as an infant ages and the height of his or her crib mattress 38 changes).

In one embodiment, such as that shown in FIG. 4, a vertical midportion of the housing 11 is located above the support surface 36 of the crib or bed 20. The support surface 36 extends parallel to the ground surface on which the crib or bed 20 is supported. Such a configuration can ensure that the entire finger-safe vent or surface 12 is able to circulate air unobstructed onto the individual sleeping in the crib or bed 20. In a different or the same embodiment, a bottom of the housing 11 is located at or above the support surface 36 of the crib or bed 20.

Optionally, the housing 11 is rotationally fixed with respect to the base 14 and/or the stand 16. In such an embodiment, the housing 11 does not oscillate, and does not give the user the option to oscillate the housing 11. This ensures that the benefits of the air circulation are focused on the sleeping surface 36, and eliminates the possibility that the user would not take advantage of the benefits of the air circulation on or at the sleeping surface 36.

As mentioned above, the device 10 can include or incorporate smart, Wi-Fi-enabled controls that allow a parent or other caregiver to manage the device remotely through an integrated iOS/Android app. This minimizes disturbances in the baby's sleeping environment. Further, parents and other caregivers can check air quality and temperature around the device 10 remotely, leveraging the device's one or more integrated sensors described above.

In one embodiment, the device 10 includes a pure-red LED nightlight that supports natural melatonin production. This nightlight can be the same as or different than the one or more integrated sleep- and/or wake-lighting features 28 described above. Optionally, the device 10 includes a multi-color "rise alarm" to help toddlers learn when to wake up.

Referring to FIG. 8, the air flow (represented by the arrows in FIG. 8) follow a unique path as compared to prior art fans and air purifiers. In particular, in the shown embodiment, air can enter the housing 11 at a lower portion thereof, and travel upwardly withing the housing 11 before it exits at a higher point. A single filter 34 is shown to be upstream of a plurality of blades 13 of a fan, though more than one filter can be used and the fan and the filter(s) 34 can be in different positions and/or orientations depending upon the needs of the user or the desired functionality of the device.

The design of FIG. 8 illustrates the innovative airflow mechanism of the presently disclosed technology designed to ensure a gentle and even distribution of purified air into a baby's sleeping area, while concealing the fan blades 13 for safety. In particularly, ambient air can be drawn into the device 10 through multiple intake vents located on the lower portion of the housing 11. This positioning ensures maximum air capture from the surrounding environment, while allowing buttons and display-panel features to be placed up the upper portion of the housing 11, at a conveniently accessible height.

The device 10 can be designed for long-term use and can be utilized from the child's infancy through their early stages of development. The device 10 is sleek, easily and quickly vertically adjustable, energy-efficient, and can be transferred from a nursery, to a playroom, and eventually to the child's bedroom as they grow older. Once the air enters the housing 11, it is directed through a high-efficiency particulate air (HEPA) filter 34. The HEPA filter 34 is strategically placed in the embodiment of FIG. 8 to be in the airflow path to remove particulate matter, including dust, allergens, and other pollutants, ensuring that only clean air is circulated. The blades 14 of the fan are positioned behind the filter 34, and are designed to pull the filtered air through the housing 11. This design ensures that the fan blades 13 are not exposed, enhancing safety, especially in environments with infants and children. The filtered air is then redirected vertically upwards within the housing 11. This vertical redirection can be achieved through one or a series of internal channels that guide the airflow smoothly and efficiently. Upon reaching the upper internal area of the housing 11, the airflow is redirected either horizontally, parallel to the ground surface or at an angle (e.g., approximately 45 degrees) with respect to the ground surface. This can be facilitated by a specially designed exit vent that channels the air outwards. The exit vent ensures that the airflow is distributed evenly across the intended area. This design is particularly beneficial for creating a uniform and gentle airflow in a baby's sleeping area, avoiding direct drafts that could disturb sleep.

The above description of the presently disclosed technology is provided as an enabling teaching of the presently disclosed technology in its best, currently known embodiment. Those skilled in the relevant art will recognize that many changes can be made to the embodiment described, while still obtaining the beneficial results of the presently disclosed technology. It will also be apparent that some of the desired benefits of the presently disclosed technology can be obtained by selecting some of the features of the present invention without utilizing other features. Accordingly, those who work in the art will recognize that many modifications and adaptations to the presently disclosed technology are possible and can even be desirable in certain circumstances, and are a part of the presently disclosed technology.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of disclosed concept which is to be given the full breadth of the claims appended and any and all equivalents thereof.

What is claimed is:

1. A combination comprising:

a crib or bed having a support surface located a predetermined distance above a ground surface, the support surface extending parallel to the ground surface, the support surface being configured to support a human or baby in a sleeping state; and a device having a housing, a generally flat base, and a support structure therebetween, the housing enclosing or supporting an air circulator and a high efficiency particulate air (HEPA) filter, the base being placed on the ground surface proximate the crib, the support structure being a cylindrical column that is vertically adjustable to adjust a height of the housing above the base, the HEPA filter being removable from the housing, wherein a vertical midportion of the housing is located above the support surface of the crib or bed, wherein the housing is directed toward the support surface of the crib or bed to circulate air at the support surface, wherein a width of the base is approximately equal to a width of the housing, wherein a length of the base is more than twice a length of the housing, wherein a bottom of the housing is located at or above the support surface of the crib or bed, and wherein the housing includes a display panel on a first side and a plurality of spaced-apart openings through which air can flow on an opposing second side.

2. The combination of claim 1, wherein the display panel is a digital display, and wherein the digital display shows a fan speed and a room temperature.

3. The combination of claim 2, wherein the base is flat when viewed from the side, and wherein the base is rectangular when viewed from above.

4. The combination of claim 3, wherein the housing is rotationally fixed with respect to the base.

5. The combination of claim 1, wherein air enters the housing at a lower portion thereof and exits the housing at an upper portion thereof.

6. The combination of claim 1, wherein the air circulator is attached to the crib or bed to prevent the air circulator from tipping over.

7. The combination of claim 6, wherein a portion of the housing is configured to illuminate.

8. The combination of claim 7, wherein the illumination is red.

9. A method of circulating air in a crib and preventing an air purifier from tipping over, the method comprising:

placing an air circulator near a crib or bed such that a vertical midportion of a housing of the air circulator is located above a support surface of the crib or bed and a bottom of the housing is located at or above the support surface of the crib or bed, wherein the support surface extends parallel to a ground surface that supports the crib or bed, wherein the air circulator includes a support structure between a generally flat base and the housing thereof, the housing including a removable filter therein, the base contacting the ground surface, the support structure being adjustable to increase or decrease a height of the housing with respect to the base, and wherein air enters the housing at a lower portion thereof and exits the housing at an upper portion thereof, and wherein the housing includes a display panel on a first side and a plurality of spaced-apart openings through which air can flow on an opposing side.

10. The method of claim 9, further comprising:

determining a condition of the filter and replacing the filter enclosed or supported by the housing.

11. The method of claim 9, further comprising:

attaching the air circulator to the crib or bed.

12. The method of claim 9, wherein the housing is rotationally fixed with respect to the base.

13. A device configured to circulate air in a crib or bed, the device comprising:

a housing enclosing an air circulator and a removable filter, an entirety of the housing being positioned above, spaced-apart from, and movable with respect to a ground surface supporting the device;

a base configured to be placed on the ground surface, and a support structure supporting the weight of the housing above the base, the support structure extending along a single axis from a bottom of the housing to a top of the base, the support structure comprising a column that is vertically adjustable along the single axis to raise or lower the housing with respect to the base and the ground surface, wherein air flows into the housing on a first side of the housing and out of the housing through a vent on a second side of the housing, the first side being opposite the second side.

14. The device of claim 13, wherein the filter is positioned upstream of the air circulator.

15. The device of claim 13, wherein the vent is positioned vertically higher than the filter.

16. The device of claim 13, wherein air enters the housing at a lower portion thereof and travels upwardly withing the housing before exiting the housing at a higher point thereof.

17. The device of claim 13, wherein the support structure includes a rotatable or axially-movable knob configured to allow a user to selectively raise or lower the housing with respect to the base and lock the housing at a desired height above the ground surface.

* * * * *